United States Patent [19]

Graham

[11] Patent Number: 4,667,728

[45] Date of Patent: May 26, 1987

[54] METHOD AND APPARATUS FOR CASTING ARTICLES

[75] Inventor: Lawrence D. Graham, Chagrin Falls, Ohio

[73] Assignee: PCC Airfoils, Inc., Euclid, Ohio

[21] Appl. No.: 854,301

[22] Filed: Apr. 21, 1986

[51] Int. Cl.[4] ..... B22D 33/04

[52] U.S. Cl. ..... 164/129; 164/127; 164/137; 164/322; 164/339

[58] Field of Search ..... 164/23, 24, 516, 121, 164/122, 122.1, 122.2, 125, 127, 129, 137, 322, 339, 350, 352, 361; 249/111

[56] References Cited

U.S. PATENT DOCUMENTS

| | | | |
|---|---|---|---|
| 3,810,504 | 5/1974 | Piwonka | 164/122.1 |
| 3,915,761 | 10/1975 | Tschinkel et al. | 164/127 |
| 4,270,594 | 6/1981 | Chumakov | 164/127 |

*Primary Examiner*—Nicholas P. Godici
*Assistant Examiner*—Richard K. Seidel
*Attorney, Agent, or Firm*—Tarolli, Sundheim & Covell

[57] ABSTRACT

In order to maintain fluid tight seals between open ended article mold cavities and a chill plate and to prevent cracking of article molds at connections with a base plate, the base plate has sections which can be moved relative to each other under the effect of thermal expansion forces transmitted from a molten metal distribution system connected with the upper ends of the article molds. The base plate may be formed as one piece with stress concentration areas. During the casting of articles, stresses in the base plate crack the base plate at the areas of stress concentration to form the separate sections of the base plate. The areas of stress concentration can be formed by slots or grooves in the base plate. The areas of stress concentration can also be formed by bodies of expansion material having a greater coefficient of thermal expansion than the ceramic material of the base plate. Upon heating of the base plate, the bodies of expansion material expand to a greater extent than the ceramic material of the base plate and crack the base plate in preselected areas which are spaced from the connections between the article molds and the base plate.

27 Claims, 10 Drawing Figures

METHOD AND APPARATUS FOR CASTING ARTICLES

BACKGROUND OF THE INVENTION

The present invention relates to a new and improved method and apparatus for casting a plurality of articles.

Ceramic mold structures having a construction similar to that disclosed in U.S. Pat. Nos. 3,810,504 and 3,915,761 may be used to cast a plurality of articles. These mold structures include a plurality of open ended article molds disposed in a circular array. Upper end portions of the article molds are connected with a distribution system into which molten metal is poured. Lower end portions of the article molds are cooled by a chill plate.

Since the lower end portions of the article molds are cooled while the upper end portions of the article molds and the molten metal distribution system remain relatively hot, there is greater thermal expansion of the upper ends of the article molds and the molten metal distribution system than the lower ends of the article molds. This can result in a tendency for the article molds to tip outwardly and open joints between the chill plate and article mold cavities. Molten metal may then run out of the open ends of the article mold cavities. In addition, thermally induced stresses may crack the lower end portions of the article molds in such a manner as to enable molten metal to run out of the article molds.

BRIEF SUMMARY OF THE INVENTION

A new and improved method and apparatus for casting articles reduces thermal stresses in a mold structure to enable fluid tight seals to be maintained between a plurality of article molds and a chill plate. Reducing thermal stresses in the mold structure also prevents cracking of article molds. This is accomplished by providing relative movement between sections of a base plate connected with the lower end portions of the article molds. The sections of the base plate are moved relative to each other by thermal expansion forces transmitted from a molten metal distribution system connected with the upper end portions of the article molds.

In order to facilitate handling of the mold structure, the base plate may be formed as one piece with the sections interconnected. Areas of stress concentration are provided in the base plate at locations spaced from connections between the article molds and the base plate. During a casting operation, thermal expansion forces cause the base plate to crack at the areas of stress concentration to separate the various sections of the base plate. The sections of the base plate can then move relative to each other under the influence of the thermal expansion forces.

The relative movement between the sections of the base plate allows bottom surface areas of the sections of the base plate to remain in abutting engagement with an upper side surface of a chill plate to prevent run outs from the article mold cavities. In addition, the relative movement between the sections of the base plate tends to minimize thermal stresses in the article molds in such a manner as to retard cracking of the article molds.

Concentration of thermal stresses in selected areas of the base plate can be accomplished by weakening the selected areas of the base plate. Thus, slots and/or grooves can be formed in the base plate at locations spaced from the article molds. During a casting operation, thermal stresses are concentrated at the slots and/or grooves. By concentrating the thermal stresses in selected areas, a cracking of the base plate at locations spaced from the article molds is achieved to separate sections of the base plate without damaging the article molds.

It is also contemplated that thermal stresses can be concentrated in preselected areas of the base plate by providing bodies of material having a relatively high coefficient of thermal expansion in the base plate. Upon heating of the base plate, the bodies having a relatively high coefficient of thermal expansion expand to a greater extent than the material of the base plate with a resulting cracking of the base plate.

Accordingly, it is the object of this invention to provide a new and improved method and apparatus for casting a plurality of articles and wherein bottom surfaces of sections of a base plate are maintained in abutting engagement with a chill plate by providing relative movement between the sections of the base plate under the influence of thermal expansion forces.

Another object of this invention is to provide a new and improved method and apparatus for casting a plurality of articles and wherein stresses in a base plate of a mold are relieved by cracking the base plate at a plurality of locations spaced from connections between the base plate and article molds.

BRIEF DESCRIPTION OF THE DRAWINGS

The foregoing and other objects and features of the present invention will become more apparent upon a consideration of the following description taken in combination with the accompanying drawings wherein.

DESCRIPTION OF SPECIFIC PREFERRED EMBODIMENTS OF THE INVENTION

General Description

Figure 1:
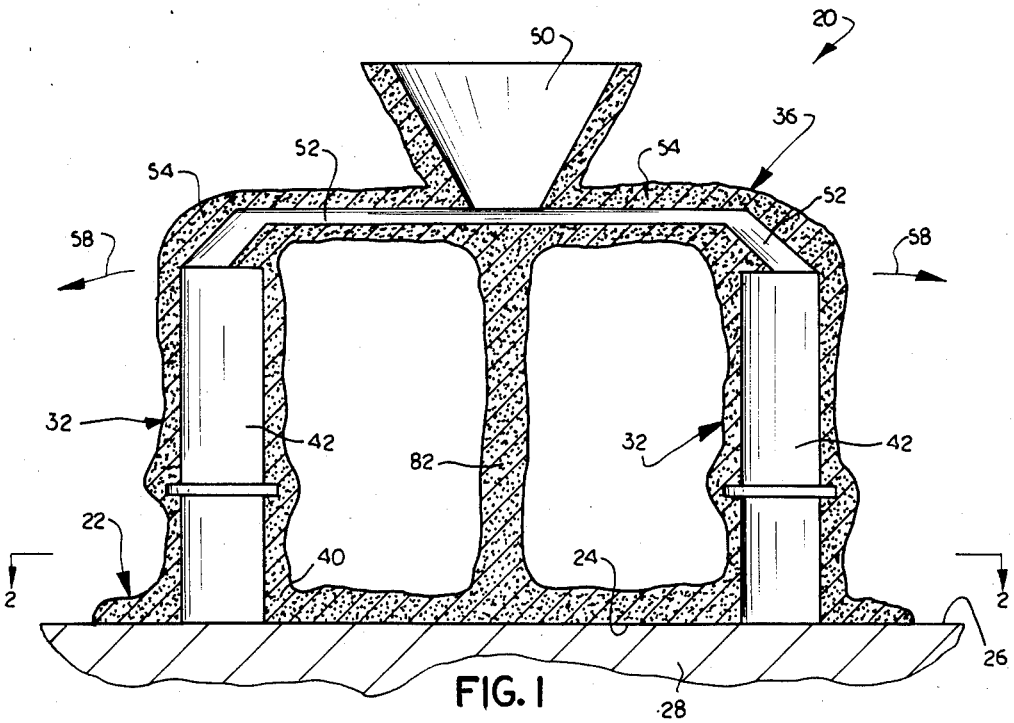
FIG. 1 is a sectional view of a one-piece ceramic mold structure and illustrating the relationship between a base plate, a plurality of article molds, and a molten metal distribution system.

A one-piece ceramic mold structure 20 (FIG. 1) is used in casting a plurality of articles, such as turbine blades. The mold structure 20 has a circular base plate 22 having a flat bottom surface 24. The bottom surface 24 of the base plate 22 is disposed in flat abutting engagement with an upper side surface 26 of a circular chill plate 28. A plurality of open ended article molds 32 are disposed in a circular array (see FIG. 2) and extend upwardly from the base plate 22 to a molten metal distribution system 36.

The ceramic article molds 32 have open ended lower portions 40 which are connected with the base plate 22. The open ended lower portions 40 of the article molds 32 enable heat to be conducted from molten metal in article mold cavities 42 to the chill plate 28. This promotes solidification of the molten metal in a direction extending upwardly from the chill plate 28. Although the mold 20 is adapted to make columnar grained cast articles, such as turbine blades, it is contemplated that the mold could be constructed to form either single crystal or equiaxed articles if desired.

The ceramic molten metal distribution system 36 is fixedly connected with the upper ends of the article molds 32. The molten metal distribution system 36 includes a generally conical pour cup 50 which is disposed in a coaxial relationship with the circular base plate 22 and circular array of article molds 32. The pour cup 50 is connected in fluid communication with the article mold cavities 42 by passages 52 formed in runners or arms 54 which extend radially outwardly from the pour cup 50 to the upper end portions of the article molds 32.

During a casting operation, the mold 20 is preheated to a relatively high temperature, for example, 2700 degrees F. Molten metal, for example a nickel chrome super alloy, is poured into the pour cup 50. The molten metal is conducted through the runners 54 to the article molds 32 to fill the open ended article mold cavities 42.

Figure 3:
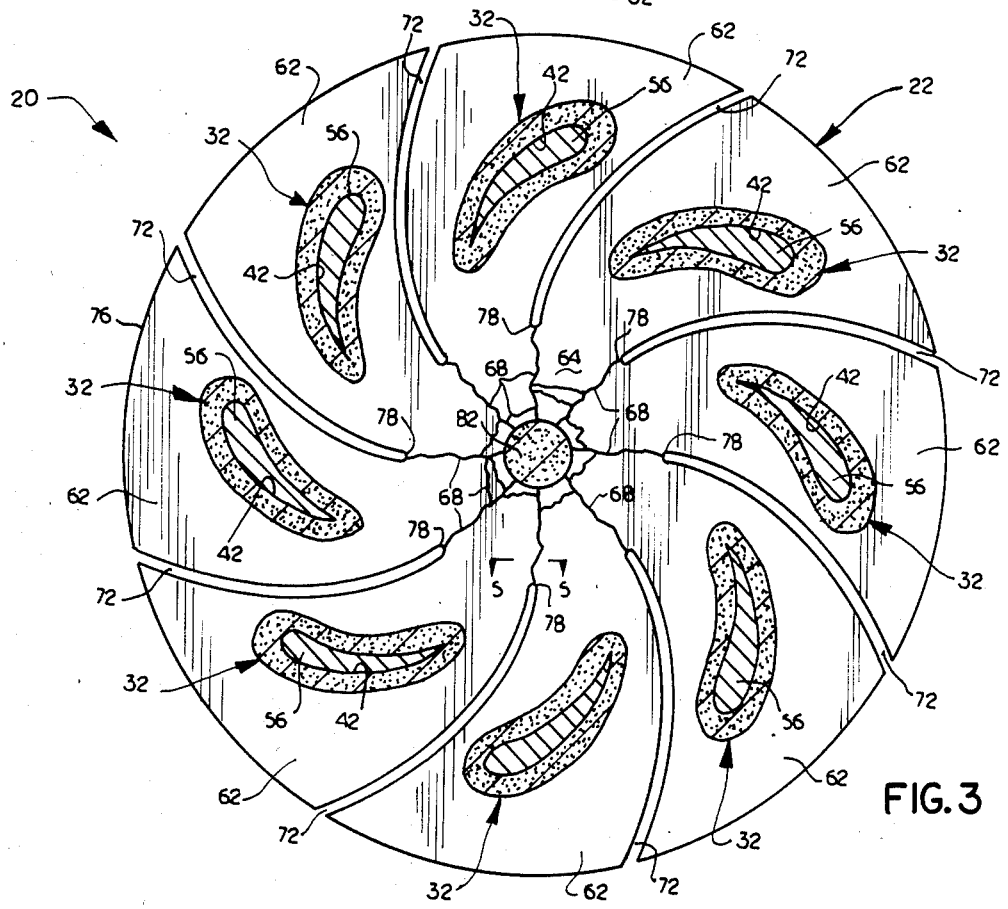
FIG. 3 is a plan view, generally similar to FIG. 2, illustrating the manner in which cracks are formed in the base plate under the influence of thermal expansion forces.

Due to a transmittal of heat from the open lower end portions 40 of the article molds 32 to the chill plate 28, the molten metal of the lower end portions of the article mold cavities 42 quickly solidifies in the manner indicated at 56 in FIG. 3. However, the metal in the upper end portions of the article mold cavities 42 and in the distribution system 36 remains molten. Since the upper end portion of the one-piece ceramic mold structure 20 is at a higher temperature than the lower portion of the mold structure, the upper portion expands to a greater extent than the lower portion of the mold structure.

The greater thermal expansion of the upper portion of the mold structure 20 results in thermal expansion forces which tend to tip the article molds 32 outwardly, that is in the direction of the arrows 58 in FIG. 1. As this occurs, the portions of the article molds 32 closest to the center of the mold structure 20 tend to lift upwardly away from the upper surface 26 of the chill plate 28. This promotes a running out of molten metal from the open ends of the article mold cavities 42 in such a manner as to result in the formation of one or more defective castings.

The thermal expansion forces applied by the molten metal distribution system 36 against the upper ends of the article molds 42 also stresses the ceramic material of the article molds 32 and base plate 22. This can result in the formation of cracks at the connections between the lower end portions 40 of the article molds 32 and the base plate 22. Molten metal may run out of the article mold cavities 42 through these cracks and result in defective castings.

In accordance with a feature of the present invention, thermal stresses in the mold structure 20 are minimized by forming the base plate 22 in a plurality of sections 62 (FIG. 2) which are moved relative to each other. This movement accommodates thermal expansion of the molten metal distribution system 36 relative to the article molds 32 and base plate 22.

Figure 2:
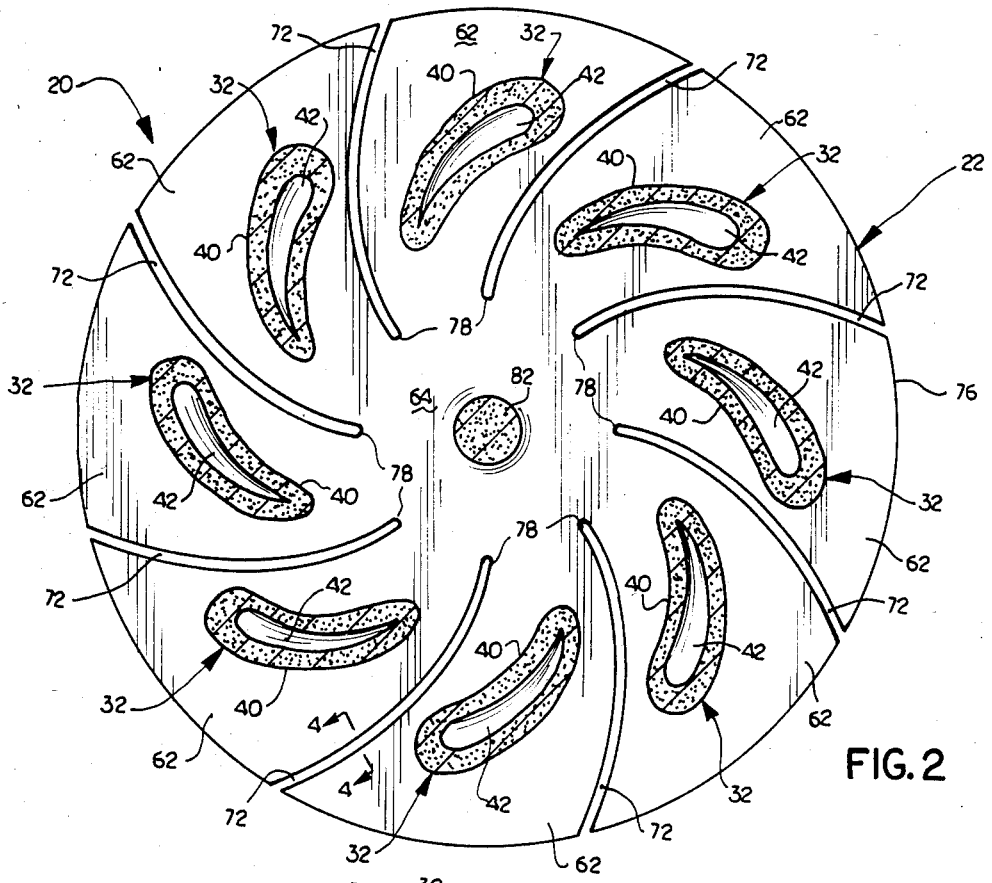
FIG. 2 is a plan view, taken generally along the line 2—2 of FIG. 1, illustrating the manner in which sections of the base plate are partially defined by slots.

The base plate 22 may be initially formed with the sections 62 interconnected by a central portion 64 of the base plate in the manner shown in FIG. 2. During a casting operation, the thermal expansion of the molten metal distribution system 36 relative to the base plate 22 results in forces being transmitted from the molten metal distribution system to the base plate. These forces are concentrated in selected areas of the base plate 22 to form stress relieving cracks 68 (FIG. 3). The cracks 68 are formed at preselected locations which are spaced from connections between the article molds 32 and the base plate 22 so that the article molds and their connections with the base plate are maintained free of cracks.

Figure 4:
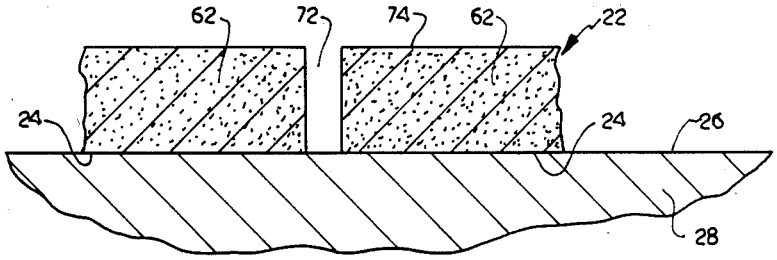
FIG. 4 is a sectional view, taken generally along the line 4—4 of FIG. 2, illustrating how a stress concentrating slot extends through the base plate.
Figure 5:
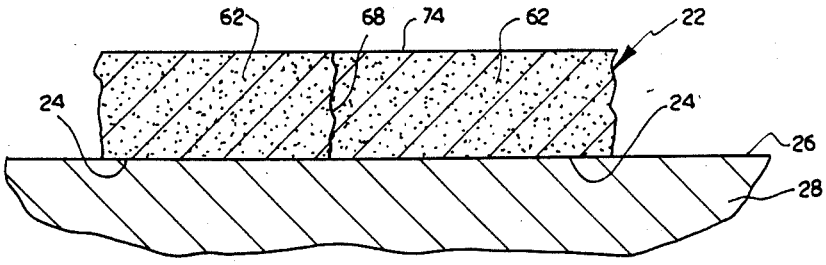
FIG. 5 is a sectional view, taken generally along the line 5—5 of FIG. 3, illustrating how a stress relieving crack extends through the base plate.

The cracks 68 (FIG. 3) separate the sections 62 of the base plate. The separate sections of the base plate are moved relative to each other by thermal expansion forces transmitted from the molten metal distribution system 36 through the article molds 32. The relative movement between the sections 62 of the base plate 22 result in the bottom surfaces 24 of the base plate sections being maintained in flat abutting engagement with the upper surface 26 of the chill plate 28 (FIGS. 4 and 5). Thus, areas of stress concentration are provided in the base plate 22 at locations spaced from connections between article molds 32 and the base plate so that the yield or fracture point of the base plate is such that it will fracture in response to the thermal stress in the mold 20 before the article molds 32 are moved or tipped sufficiently to open the joints between the article molds and the chill plate 28 and/or to fracture the mold 20 at the connections between the article molds and base plate.

The thermal stresses induced during preheating of the mold structure 20 may be sufficiently concentrated in weakened areas of the base plate 22 to cause the stress relieving cracks 68 to form. However, handling of the mold structure 20 is facilitated if the base plate 22 is formed with sufficient strength to resist the thermal stresses induced during preheating of the mold structure. When the base plate 22 is constructed with sufficient strength to resist thermal stresses during preheating, the cracks 68 form in areas of stress concentrated upon pouring of molten metal into the distribution system 36. An optimum combination of handling strength and thermal stress relief may be obtained by concentrating stresses in the base plate 22 in such a manner that a portion of the cracks 68 are formed during preheating of the mold structure 20 and the remainder of the cracks are formed upon pouring of the molten metal.

Regardless of when the cracks 68 are formed during the casting process, once the cracks have been formed the separate sections 62 of the base plate are moved radially outwardly, through relatively small distances, by thermal expansion forces. This results in the bottom surface 24 of the base plate 22 being maintained in flat abutting engagement with the upper surface 26 of the chill plate 28 to prevent a run out of molten metal from the open lower end portions of the article mold cavities 42. In addition, the stresses in the base plate 22 are relieved as the cracks 68 are formed in the central portion 64 (FIG. 3) of the base plate. Therefore, cracks are not formed at the connections between the article molds 32 and the base plate 22.

Base Plate Stress Concentration-Slots

To form the cracks 68 in the base plate 22 at locations spaced from the article molds 32, it is necessary to concentrate the stresses induced in the base plate. This is done by weakening the base plate 22 in selected areas. In the embodiment of the invention illustrated in FIGS. 2 and 3, stresses resulting from unequal thermal expansion of the upper and lower portions of the mold structure 20 are concentrated in the central portion 64 of the base plate 22 by a plurality of slots 72.

The slots 72 extend between opposite major circular side surfaces 24 and 74 (FIG. 4) of the ceramic base plate 22. The slots extend from a circular outer edge 76 of the base plate 22 (FIG. 2) to end surfaces 78 adjacent the central portion 64 of the base plate. The slots 72 divide the one-piece base plate 22 into a plurality of interconnected sections 62. Although the base plate 22 is weakened by the slots 22, it is formed as one-piece and has sufficient strength to enable it to be handled during formation of the mold 20 and the setting up of the mold in a furnace.

During a casting operation, the slots 72 concentrate stresses in the central portion 64 of the base plate 22. These stresses are sufficient to form cracks 68 (FIG. 3) which extend between opposite major side surfaces 24 and 74 (FIG. 5) of the base plate 22. The cracks 68 radiate inwardly from the inner end surfaces 78 of the slots 72 to the central portion 64 of the base plate and around a support post 82 which extends upwardly to the molten metal distribution system 36.

Since the cracks 68 extend axially through the circular base plate 22, they separate the sections 62 of the base plate. This allows the sections 62 of the base plate to be moved relative to each other to relieve the thermal stresses in the base plate and to maintain the bottom surface 24 of the base plate in flat abutting engagement with the top surface 26 of the chill plate 28 during thermal expansion of the molten metal distribution system 36 relative to the base plate. Since the slots 72 extend radially inwardly from the circular outer edge 76 of the base plate 22 to end surfaces 78 disposed inwardly of the article molds 32, the cracks 68 will be formed in the central portion 64 of the base plate at locations radially inwardly of the circular array of article molds 32. This results in the connections between the article molds 32 and the base plate 22 being maintained free of cracks.

Although the slots 72 have been illustrated in FIGS. 2 and 3 as having open outer ends at the circular edge 76 of the base plate, the ends of the slots could be closed to increase the strength of the base plate 22 prior to performing a casting operation. If desired, the slots 72 could be closed at the radially outer ends and interconnected at their radially inner ends. Although it is preferred to provide a slot 72 between each of the article molds 32 so that there is only one article mold on each section 62, the number of slots 72 could be reduced so that there would be two or even three molds connected with one of the sections 62. Thus, a single slot could be provided to divide the base plate into only two sections.

Base Plate Stress Concentration-Expansion Material

Figure 6:
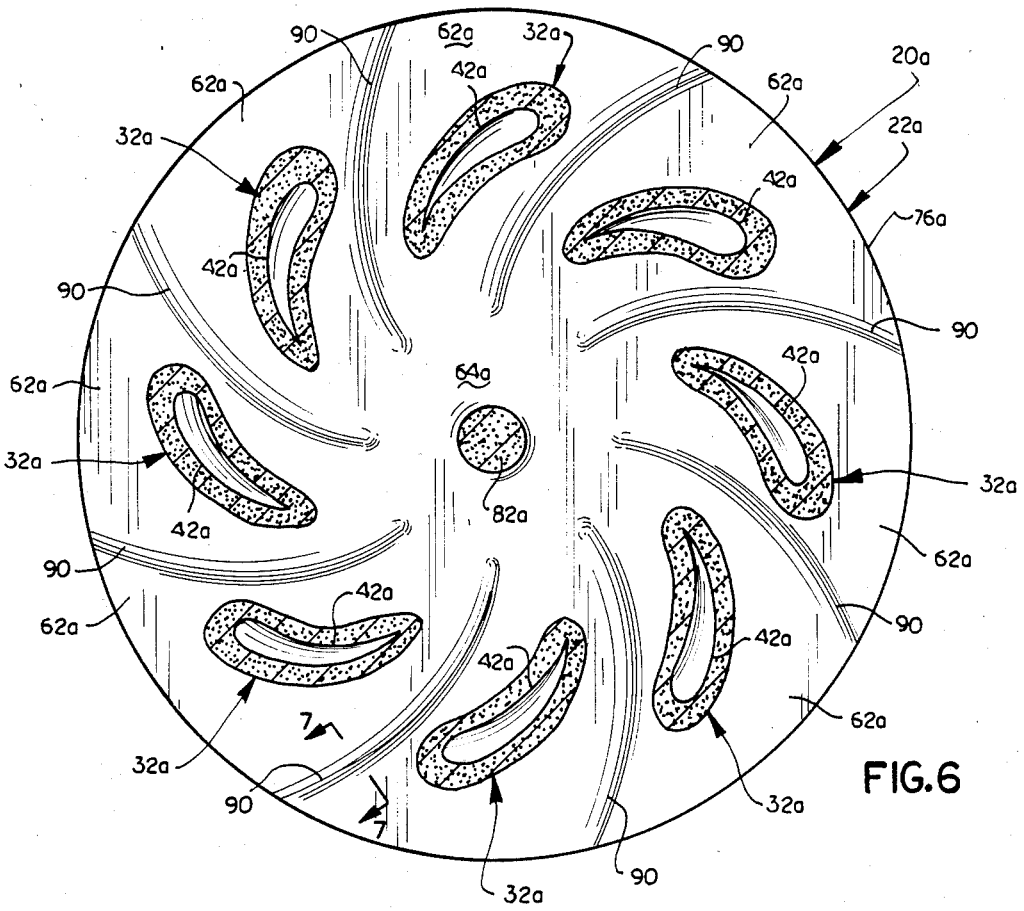
FIG. 6 is a plan view, generally similar to FIG. 2, of an embodiment of the invention in which bodies of expansion material having a greater coefficient of thermal expansion than the ceramic material of the base plate concentrate stresses in the base plate.
Figure 7:
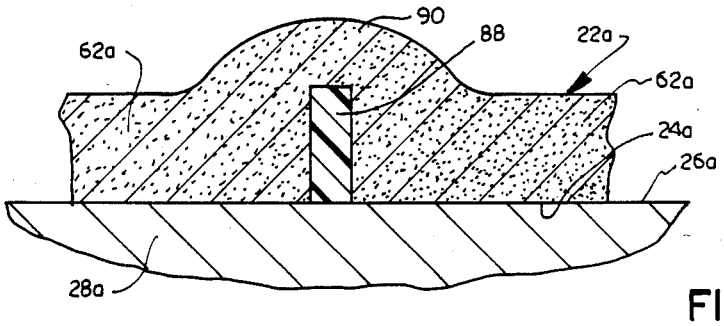
FIG. 7 is a sectional view, taken generally along the line 7—7, illustrating the relationship between one of the bodies of expansion material and the base plate.

In the embodiment of the invention shown in FIGS. 1–5, stresses in the ceramic base plate 22 are concentrated in the central portion 64 of the base plate by the slots 72. In the embodiment of the invention shown in FIGS. 6 and 7, stresses are concentrated by providing bodies of expansion material in the base plate. Since the embodiment of the invention shown in FIGS. 6 and 7 is generally similar to the embodiment of the invention shown in FIGS. 1–5, similar numerals will be utilized to designate similar components, the suffix letter "a" being associated with the numerals of FIGS. 6 and 7 to avoid confusion.

The one-piece ceramic mold structure **20*a* (FIG. 6) has a circular base plate 22*a*. A plurality of article molds 32*a* are connected with an extent upwardly from the base plate. The article molds 32*a* have mold cavities 42*a* with open lower ends which are exposed to the upper side surface of a chill plate. The article molds 32*a* extend upwardly from the base plate 22*a* to a molten metal distribution system (not shown) having a construction which is the same as the construction of the molten metal distribution system 36 of FIG. 1. It should be understood that the mold structure 20*a* of FIG. 6 has the same general construction as the mold structure 20 of FIGS. 1 and 2**.

In accordance with a feature of this embodiment of the invention, bodies 88 (FIG. 7) of expansion material are disposed in the ceramic material of the base plate **22*a* . In the illustrated embodiment of the invention, bodies 88 of expansion material are strips having a rectangular cross-sectional configuration and a length which is approximately the same as the length of the slots 72 of FIG. 2. The strips 88 of expansion material extend from a circular outer side surface 76*a* of the base plate 22*a* to a central portion 64*a* of the base plate. The strips 88 of expansion material are covered by ceramic material of the base plate 22*a* in a manner which results in the formation of a plurality of ridges 90 which divide the base plate into a plurality of sections 62*a***.

The bodies 88 of expansion material have a coefficient of thermal expansion which is greater than the coefficient of thermal expansion of the ceramic material forming base plate **22*a*. In one specific instance, the strips 88** of expansion material were formed of a polymeric material which is commercially available under the trademark "Teflon". The coefficient of thermal expansion of "Teflon", that is, the change in length per unit length per degree change in temperature, is approximately 110 per degree C.

The base plate **22*a* is made of a ceramic mold material. The entire mold structure 20*a*, including base plate 22*a*, is formed by repeatively dipping a pattern in a liquid slurry of ceramic mold material. The slurry of ceramic mold material contains fused silica, zircon and other refractory materials in combination with binders. Chemical binders such as ethyl silicate, sodium silicate and colloidal silica can be utilized. In addition, the slurry may contain suitable film formers such as alginates to control viscosity and wetting agents to control flow characteristics and pattern wettability. The ceramic mold material of the base plate 22*a*** has a coefficient of thermal expansion of approximately 10 per degree C. It should be understood that the mold structure 20 is formed in the same way and of the same ceramic material as the mold structure 20a.

During a casting operation, the mold structure 20a is placed in a furnace on a chill plate 28a and is preheated to approximately 2,700 degrees F. As the mold is preheated, the bodies 88 of expansion material thermally expand to a greater extent than the ceramic material of the base plate 22a. Due to the relatively large expansion of the bodies 88, cracks are formed in the one-piece base plate 22a during preheating of the mold structure 20a. These cracks extend along the ridges 90 from the circular outer side surfaces 76a to the central portion 64a of the base plate 22a. However, the cracks do not intersect so as to divide the base plate into separate sections.

Upon pouring of molten metal into a pour cup in the molten metal distribution system, the molten metal flows outwardly through runners to each of the article mold cavities 42a. The molten metal in the lower end portion of the article mold cavities 42a immediately solidifies. However, the metal in the distribution system remains molten. Therefore, there is thermal expansion of the distribution system relative to the relatively cool base plate 22a.

During pouring of molten metal to the article mold cavities 42a and solidification of the molten metal in the article mold cavities 42a, thermal expansion forces are transmitted from the molten metal distribution system to the article molds 32a to the base plate 22a. These thermal expansion forces cause the cracks which were formed at the ridges 90 to extend into the central portion 64a of the base plate. The cracks intersect in the central portion 64a of the base plate to separate the sections 62a of the base plate in the same manner as in which the cracks 68 of FIG. 3 separate the sections 62 of the base plate 22.

Once the sections 62a of the base plate 22a have been separated by a cracking of the base plate under the influence of thermally induced stresses, the sections of the base plate can be moved relative to each other under the influence of thermal expansion forces in the molten metal distribution system. This results in the flat bottom surface 24a (FIG. 7) of the base plate 22a being maintained in flat abutting engagement with the upper surface 26a of the chill plate 28a. Therefore, a fluid tight seal can be maintained between the bottom surface 24a of the base plate 22a and the top surface 26a of the chill plate 28a to prevent a run out of molten metal from the article mold cavities 42a. Since the cracks are formed in the base plate 22a at preselected locations spaced from the article molds 32a, the article molds and their connections with the base plate are maintained free of cracks.

In the embodiment of the base plate 22a shown in FIGS. 6 and 7, the bodies 88 of expansion material extend radially inwardly from the circular outer side surface 76a of the base plate to the central portion 64a of the base plate in the same manner as the slots 72. However, it is contemplated that the bodies 88 of thermal expansion material could extend from locations adjacent to and radially inwardly of the outer side surface 76a of the base plate to locations closer to the support post 82a in the central portion 64a of the base plate. In fact, the bodies of expansion material 88 could extend from the side surface 76a and be interconnected at the central portion 64a of the base plate. This would result in the formation of cracks to separate the sections 62a during the preheating of the mold structure 20a and would not require the subsequent cracking of the mold under the influence of thermal expansion forces transmitted from the molten metal distribution system to the base plate 22a through the article molds 32a.

Base Plate Stress Concentration-Grooves

In the embodiments of the invention illustrated in FIGS. 1–7, stresses were concentrated in the base plate of a mold structure by either slots 72 (FIGS. 2 and 3) or bodies 88 of expansion material (FIG. 7). However, it is contemplated that the stresses could be concentrated in the base plate by weakening of the base plate with grooves in the manner shown in the embodiment of the invention illustrated in FIG. 8. Since the embodiment of the invention shown in FIG. 8 is generally similar to the embodiment of the invention shown in FIGS. 1–5, similar numerals will be utilized to designate similar components, the suffix letter "b" being associated with the numerals of FIG. 8 to avoid confusion.

Figure 8:
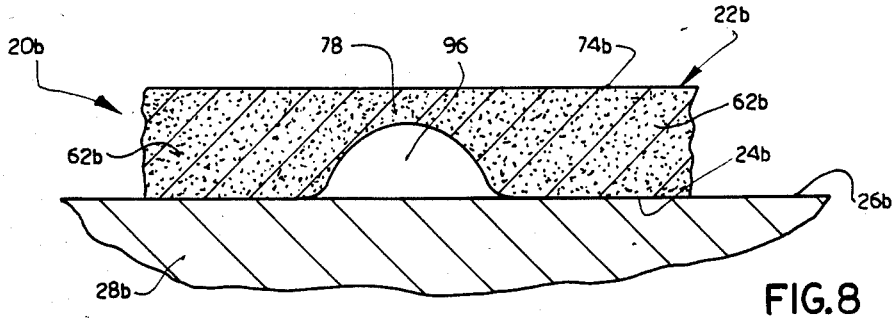
FIG. 8 is a sectional view, generally similar to FIGS. 4. and 7, of an embodiment of the invention in which a stress concentrating groove is provided between sections of a base plate.

The one-piece ceramic mold structure 20b of FIG. 8 has a circular base plate 22b which is disposed on a chill plate 28b. A plurality of article molds (not shown) extend upwardly from the base plate 22b to a molten metal distribution system (not shown) in the same manner as illustrated in FIG. 1 for the mold structure 20. It should be understood that the mold structure 20b has the same general construction as the mold structures 20 and 20a.

In accordance with a feature of the embodiment of the base plate 22b shown in FIG. 8, stresses are concentrated in the base plate by a plurality of grooves 96. The grooves 96 extend between and are spaced from the article molds in the same manner in which the slots 72 of FIG. 2 are spaced from the article molds 32. Like the slots 72 of FIG. 2, the grooves 96 extend from a circular outer edge (not shown) of the base plate 22b to a central portion of the base plate.

When the molten metal is poured into the mold 20b, the molten metal distribution system remains relatively hot while the base plate 22b remains relatively cool under the influence of the chill plate 28b. This results in the molten metal distribution system expanding to a greater extent than the base plate 22b. Thermal expansion forces are transmitted from the molten metal distribution system through the article molds to the base plate 22b.

The stresses resulting from the thermal expansion forces transmitted to the base plate 22b are concentrated at relatively thin portions 98 disposed between the groove 96 and upper side surface 74b of the base plate 22b. This results in the formation of cracks which are coextensive with the groove 96. These cracks will extend into and intersect at the central portion of the base plate 22b in the same manner as in which the cracks 68 are formed in the central portion 64 of the base plate 22 of FIG. 3.

The cracks extend axially through the circular base plate 22b and separate the base plate into a plurality of sections 62b. The sections 62b can be moved relative to each other to maintain the lower side surface 24b of the base plate 22b in flat abutting engagement with the upper side surface 26b of the chill plate 28b. Since the cracks are formed in the base plate 22b at locations spaced from the article molds, that is at locations where the grooves 96 are formed or the base plate 22b at locations spaced from the article molds, that is at locations where the grooves 96 are formed or in the central portion of the base plate, the article molds and their connections with the base plate 22b are maintained free of cracks during the casting operation.

Two-Piece Mold Assembly

Figure 9:
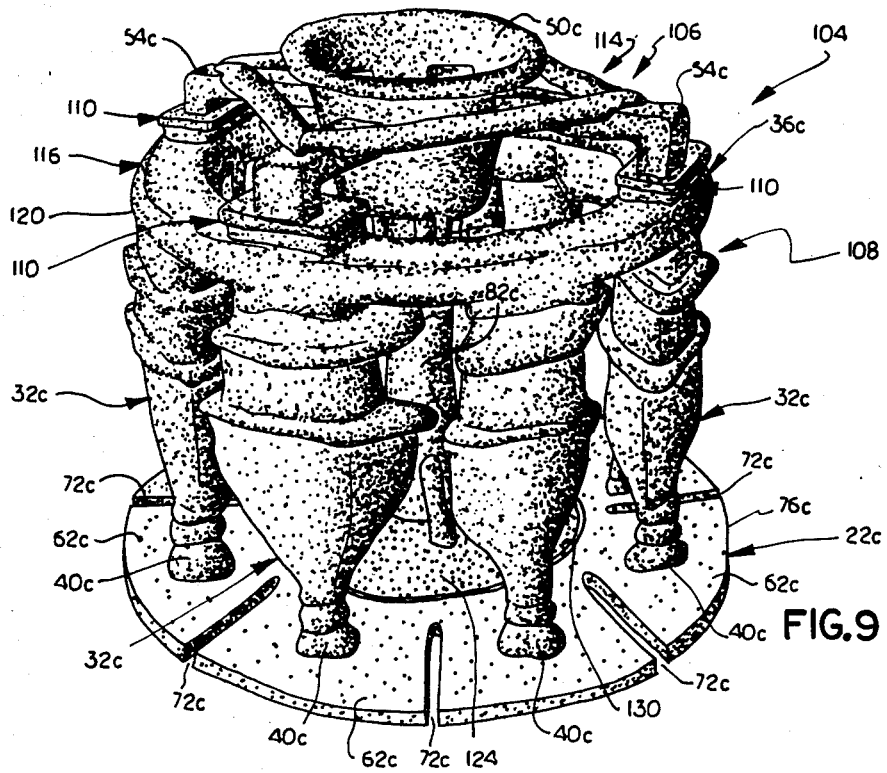
FIG. 9 is a pictorial illustration of a two-piece mold structure having a base plate with sections which are partially defined by stress concentrating slots.

Although the present invention may advantageously be used with a one-piece ceramic mold structure, the invention may also be used with a two-piece ceramic mold assembly 104 illustrated in FIG. 9. Since the mold assembly 104 of FIG. 9 has many components which are similar to the components of the mold structure 20 of FIG. 1, similar numerals will be utilized to designate similar components, the suffix letter "c" being associated with the embodiment of the invention shown in FIG. 9 to avoid confusion.

The mold assembly 104 of FIG. 9 includes a one-piece upper ceramic mold structure 106 and a one-piece lower ceramic mold structure 108. The upper and lower mold structures 106 and 108 are interconnected at a plurality of separable joints 110. During a casting operation, the upper and lower mold structures 106 and 108 can be separated to enable the lower mold structure 108 to be removed from a furnace while the upper mold structure 106 remains in the furnace.

A molten metal distribution system 36c includes a primary molten metal distribution system 114 in the upper mold structure 106 and a secondary molten metal distribution system 116 in the lower mold structure 108. The primary and secondary molten metal distribution systems 114 and 116 are connected in fluid communication with each other through the joints 110. The primary molten metal distribution system 114 includes a pour cup 50c and a plurality of hollow runners 54c. The secondary molten metal distribution system 116 includes a hollow annular ceramic ring 120 which is integrally formed with and fixedly connected to upper end portions of a plurality of ceramic article molds 32c. A passage in the hollow ring 120 is connected in fluid communication with open ended mold cavities in the article molds 32c.

Lower end portions 40c of the article molds 32c are integrally formed with and fixedly connected to an annular ceramic base plate 22c. The annular ceramic base plate 22c circumscribes a circular baffle plate 124 which is connected with the pour cup 50c by a support post 84c. When the upper and lower mold structures 106 and 108 are interconnected in the manner shown in FIG. 9, the baffle plate 124 is disposed in a circular opening in the center of the base plate 22c.

In accordance with a feature of this embodiment of the invention, a plurality of slots 72c extend radially inwardly from a circular outer side surface 76c of the base plate 22c. The slots 72c stop short of a circular inner side surface 130 of the annular base plate 22c. Therefore, arcuate sections 62c of the base plate 22c are interconnected at the central portion of the base plate.

When a plurality of articles are to be cast with the mold assembly 104, the mold assembly is placed on a chill plate which is raised into a furnace. The upper mold structure 106 is connected with an upper end wall of the furnace. Molten metal is then poured into the pour cup 50c. The molten metal flows from the pour cup 50c through the primary distribution system 114 and joints 110 to the secondary distribution system 74. The molten metal then flows from the annular ring 120 of the secondary distribution system 116 to the article molds 32c.

The annular ring section 120 of the secondary distribution system 116 is fixedly connected with the upper end portions of the ceramic molds 32c. Since the base plate 22c disposed on a chill plate and the metal in the lower end portions of the open ended cavities in the article molds 32c are exposed to the chill plate, the secondary molten metal distribution system 116 will be at a higher temperature than the base plate 22c. The resulting thermal expansion of the distribution ring 120 relative to the base plate 22c results in thermal expansion forces being transmitted from the secondary distribution system 116 through the article molds 32c to the base plate 22c.

The slots 72c concentrate the stresses induced by the thermal expansion forces to crack the base plate 22c. The cracks extend from radially inner most end portions of the slots 72c to the circular inner surface 130 of the base plate. This results in the sections 62c of the base plate 22c being separated from each other. The base sections 62c can then be moved radially outwardly by thermal expansion forces to maintain a flat bottom surface of the base plate 22c in abutting engagement with an upper surface of the chill plate. The cracks in the base plate 22c are formed at locations spaced from the connections between the article molds 34c and the base plate 22c.

Once the article molds 32c have been filled with molten metal, the lower mold structure 108 is gradually lowered from the furnace. As this occurs, the upper and lower mold structures 106 and 108 separate at the joints 110 and the article molds 32c move downwardly past the stationary baffle plate 124. The baffle plate 124 blocks the radiation of heat from the portion of the article molds disposed above the baffle plate 124 to the chill plate and the outside of the furnace. The manner in which the mold assembly 104 is used to cast a plurality of articles is more fully explained in International Patent Application Ser. No. PCT/US86/00166 entitled "Method and Apparatus for Casting Articles", filed Jan. 28, 1986, for Lawrence Graham, Richard Skelley, Daniel Fetsko and Ronald Ardo.

It should be understood that although open ended slots 72c have been utilized in the embodiment of the invention shown in FIG. 9 to concentrate thermal stresses at selected areas in the base plate 22c, closed ended slots could be used if desired. The slots could begin and end in the ceramic base plate 22c. However, if it is preferred to use open ended slots, it is contemplated that the open ends of the slots could be provided at the inner edge 130 and the slots terminated before they reach the outer edge 76c.

In addition, it is contemplated that other stress concentration devices could be utilized if desired. For example, grooves similar to the grooves 96 of FIG. 8 could be formed in the base plate 22c. Similarly, bodies of material having a greater coefficient of expansion than the ceramic material of the base plate 22c could be used in the manner previously explained in connection with FIGS. 6 and 7. If bodies of expansion material, that is Teflon, were used, they could extend from the outer side surface 76c to the inner side surface 130 to enable the sctions 62c to be completely separated during preheating of the mold assembly 104.

Base Plate—Plural Sections

In the mold structures illustrated in FIGS. 1 through 9, the base plates have been initially formed as one piece with a plurality of interconnected sections. In the embodiment of the invention illustrated in FIG. 10, the base plate is initially formed as a plurality of separate pieces. Since the embodiment of the invention shown in FIG. 10 is generally similar to the embodiment of the invention shown in FIGS. 1–9, similar numerals will be utilized to designate similar components, the suffix letter "d" being associated with the numerals of FIG. 10 to avoid confusion.

A one-piece ceramic mold structure 20*d* (FIG. 10) includes a circular ceramic base plate 22*d*. A plurality of ceramic article molds 32*d* extend upwardly from the base plate 22*d* to a molten metal distribution system having the same construction as the molten metal distribution system 36 of FIG. 1. It should be understood that the mold structure 20*d* has the same general construction as the mold of 20 of FIG. 1.

In accordance with a feature of this embodiment of the invention, the base plate 22*d* is divided into a plurality of separate sections 62*d* by slots 72*d*. The slots 72*d* extend inwardly from a circular outer edge or side 76*d* of the base plate 22*d* to an intersection 134 in a central portion 64*d* of the base plate 22*d*. Since the slots intersect at the central portion 64*d* of the base plate 22*d*, it is not necessary the crack the base plate to separate the sections 62*d* of the base plate in the manner explained in conjunction with the embodiments of the invention shown in FIGS. 1–9.

Figure 10:
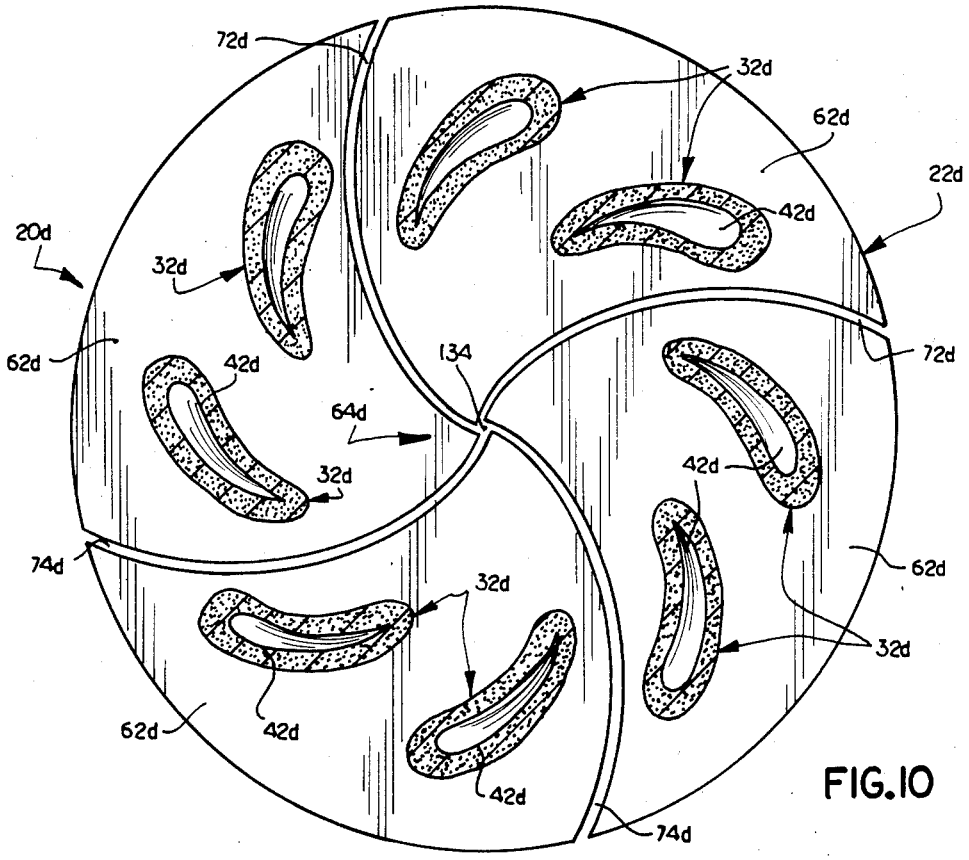
FIG. 10 is a plan view, generally similar to FIGS. 2 and 6, illustrating the manner in which separate sections of a base plate are defined by slots.

In the embodiment of the invention shown in FIG. 10, a pair of article molds 32*d* extend upwardly from each of the sections 62*d* of the base plate 22*d* to the molten metal distribution system. The rigid ceramic molten metal distribution system is fixedly connected with the upper ends of the article molds 32*d*.

During a casting operation, the base plate 22*d* is disposed on a chill plate. Molten metal is poured into the distribution system and is then conducted to open ended article mold cavities 42*d* in the molds 32*d*. Molten metal in the lower end portions of the article mold cavities 42*d* is cooled by the chill plate and solidifies while the metal in the distribution system remains molten. This results in thermal expansion of the ceramic molten metal distribution system relative to the ceramic base plate 22*d*. Thermal expansion forces are transmitted from the molten metal distribution system to the base plate 22*d* by the article molds 32*d*. These thermal expansion forces move the sections 62*d* outwardly to maintain the bottom surfaces of the base plate sections 62*d* in flat abutting engagement with the upper side surface of the chill plate. This prevents a running out of molten metal from the open lower end portions of the article mold cavities 32*d*.

Conclusion

A new and improved method and apparatus for casting articles reduces thermal stresses in a mold structure 20 to enable fluid tight seals to be maintained between a plurality of article molds 32 and a chill plate 28. Reducing thermal stresses in the mold structure 20 also prevents cracking of article molds 32. This is accomplished by providing relative movement between sections 62 of a base plate 22 connected with the lower end portions of the article molds 32. The sections 62 of the base plate 22 are moved relative to each other by thermal expansion forces transmitted from a molten metal distribution system 36 connected with the upper end portions of the article molds 32.

In order to facilitate handling of the mold structure 20, the base plate 22 may be formed as one piece with the sections 62 interconnected. Areas of stress concentration are provided in the base plate 22 at locations spaced from connections between the article molds and the base plate 22. During a casting operation, thermal expansion forces cause the base plate 22 to crack at the areas of stress concentration to separate the various sections of the base plate. The sections 62 of the base plate 22 can then move relative to each other under the influence of the thermal expansion forces.

The relative movement between the sections 62 of the base plate 22 allows bottom surface areas 24 of the sections of the base plate to remain in abutting engagement with an upper side surface 26 of a chill plate 28 to prevent run outs from the article mold cavities 42. In addition, the relative movement between the sections 62 of the base plate 22 tends to minimize thermal stresses in the article molds 32 in such a manner as to retard cracking of the article molds.

Concentration of thermal stresses in selected areas of the base plate 22 can be accomplished by weakening the selected areas of the base plate. Thus, slots 72 and/or grooves 96 can be formed in the base plate 22 at locations spaced from the article molds 32. During a casting operation, thermal stresses are concentrated at the slots 72 and/or grooves 96. By concentrating the thermal stresses in selected areas, a cracking of the base plate 22 at locations spaced from the article molds 32 is achieved to separate sections 62 of the base plate without damaging the article molds.

It is also contemplated that thermal stresses can be concentrated in preselected areas of the base plate 22 by providing bodies 88 of material having a relatively high coefficient of thermal expansion in the base plate. Upon heating of the base plate, the bodies 88 having a relatively high coefficient of thermal expansion expand to a greater extent than the material of the base plate with a resulting cracking of the base plate.

Having described specific preferred embodiments of the invention, the following is claimed:

1. A method of casting a plurality of articles, said method comprising the steps of providing a ceramic mold having a base plate and plurality of article molds connected to and extending upwardly from the base plate to a molten metal distribution system, pouring molten metal into the molten metal distribution system, inducing stresses in the base plate, and relieving the stresses in the base plate by cracking the base plate at a plurality of locations spaced from connections between the base plate and article molds while maintaining the connections between the article molds and base plate free of cracks.

2. A method as set forth in claim 1 wherein said step of inducing stresses in the base plate includes the step of solidifying metal in the article molds while metal in the distribution system is molten.

3. A method as set forth in claim 1 wherein said step of providing a ceramic mold having a base plate and a plurality of article molds includes providing a mold having a ceramic base plate with a body of material having a coefficient of thermal expansion which is greater than the coefficient of thermal expansion of the ceramic base plate and disposed in the base plate, said step of inducing stresses in the base plate including the step of heating the base plate and the body of material, and thermally expanding the body of material to a greater extent than the base plate, said step of relieving stresses in the base plate including cracking the base plate under the influences of stresses induced in the base plate by thermal expansion of the body of material.

4. A method as set forth in claim 1 wherein said step of providing a mold includes the step of providing a mold having a base plate with a plurality of slots which extend away from an edge portion of the base plate to locations adjacent to a central portion of the base plate, said step of cracking the base plate includes the step of forming cracks extending from ends of the slots into the central portion of the base plate.

5. A method as set forth in claim 1 wherein said step of providing a base plate includes providing a base plate having an opening in the central portion of the base plate, said step of cracking the base plate includes forming cracks which extend to the opening in the central portion of the base plate.

6. A method as set forth in claim 1 wherein said step of inducing stresses in the base plate includes conducting heat from the base plate to cool the base plate to a temperature which is less than the temperature of the molten metal distribution system.

7. A method as set forth in claim 1 wherein said step of cracking the base plate includes dividing the base plate into a plurality of separate sections, and, thereafter, moving at least one of the sections of the base plate relative to other sections of the base plate under the influence of thermal expansion forces.

8. A method as set forth in claim 7 wherein said step of moving one of the sections of the base plate under the influence of thermal expansion forces includes transmitting thermal expansion forces from the molten metal distribution system to the one section of the base plate.

9. A method as set forth in claim 1 wherein said step of providing a mold includes providing a mold having a base plate with a plurality of grooves, said step of cracking the base plate includes cracking the base plate at the grooves.

10. A method as set forth in claim 1 wherein the molten metal distribution system includes a primary distribution system separate from the article molds, a secondary distribution system connected to the article molds and a plurality of separable joints interconnecting the primary and secondary distribution systems, said method further including the steps of conducting a flow of molten metal from the primary distribution system through the separable joints and secondary distribution system to the article molds, and separating the primary and secondary distribution systems at the separable joints after having performed said step of conducting molten metal from the distribution system to cavities in the article molds.

11. A method of casting a plurality of articles, said method comprising the steps of providing a ceramic mold having a plurality of ceramic base sections with flat bottom surfaces, a plurality of ceramic article molds each of which is connected to and extends upwardly from a base section and a ceramic molten metal distribution system fixedly connected to upper end portions of the article molds, said method further including the steps of positioning the bottom surfaces of the base sections in flat abutting engagement with a chill plate, conducting molten metal from the distribution system to cavities in the article molds while maintaining the distribution system fixedly connected with the upper end portions of the article molds, cooling the lower end portions of the article molds and the base sections to a temperature which is lower than the temperature of the distribution system by conducting heat from the article molds and the base sections to the chill plate, and maintaining the bottom surfaces of the base sections in flat abutting engagement with the chill plate by moving one of the base sections relative to another base section under the influence of thermal expansion forces transmitted from the distribution system to the one base section.

12. A method as set forth in claim 11 wherein said step of providing a ceramic mold having a plurality of base sections includes the steps of providing a ceramic mold having a one-piece base and cracking the one-piece base to form separate base sections.

13. A method as set forth in claim 11 wherein the molten metal distribution system has a generally circular configuration and the base sections are disposed in a circular array, said method further including thermally expanding the distribution system to increase the outside diameter of the distribution system, said step of maintaining the bottom surfaces of the base sections in flat abutting engagement with the chill plate includes increasing the diameter of the circular array of base sections.

14. A method as set forth in claim 11 wherein the molten metal distribution system includes a primary distribution system separate from the article molds, a secondary distribution system connected to the article molds and a plurality of separable joints interconnecting the primary and secondary distribution systems, said method further including the steps of conducting a flow of molten metal from the primary distribution system through the separable joints and secondary distribution system to the article molds, and separating the primary and secondary distribution systems at the separable joints after having performed said step of conducting molten metal from the distribution system to cavities in the article molds.

15. A ceramic mold for use in casting a plurality of articles, said mold comprising a plurality of article molds each of which has an article mold cavity with a configuration corresponding to the configuration of one of the articles, molten metal distribution means fixedly connected with upper end portions of the article molds for conducting molten metal to each of the article mold cavities, and a base plate connected with lower end portions of said article molds, said base plate including stress concentration means for defining a plurality of weakened locations spaced from said article molds to promote cracking of the base plate at the weakened locations under the influence of stresses induced in said base plate during the casting of articles.

16. A mold as set forth in claim 15 wherein said stress concentation means includes surface means for defining a plurality of slots extending away from an edge portion of said base plate to end surfaces disposed in and extending through said base plate at locations spaced from said article molds.

17. A mold as set forth in claim 15 wherein said stress concentration means includes surface means for defining a plurality of grooves extending away from an edge portion of said base plate at locations spaced from said article molds.

18. A mold as set forth in claim 15 wherein said base plate has a circular outer edge portion which is disposed outwardly of the lower end portions of said article molds and a circular inner edge portion which is disposed inwardly of the lower end portions of said article molds.

19. A mold as set forth in claim 18 wherein said stress concentration means includes surface means for defining a plurality of slots extending away from one of said edge portions of said base plate to end surfaces disposed in and extending through said base plate at locations spaced from the other one of said edge portions.

20. A mold as set forth in claim 15 wherein said stress concentration means includes surface means for defining a plurality of grooves which extend away from an edge portion of said base plate at locations spaced from said article molds.

21. A mold as set forth in claim 15 wherein said stress concentration means includes a plurality of bodies of expansion material having a greater coefficient of thermal expansion than ceramic material of said base plate.

22. A ceramic mold for use in casting a plurality of articles, said mold comprising a plurality of article molds each of which has an article mold cavity with a configuration corresponding to the configuration of one of the articles, rigid molten metal distribution means fixedly connected with upper end portions of the article molds for conducting molten metal to each of the article mold cavities, and a rigid base plate connected with lower end portions of said article molds, said base plate including a body of ceramic material and means for cracking said body of ceramic material upon heating of the ceramic mold, said means for cracking said body of ceramic material including expansion material having a coefficient of thermal expansion which is greater than the coefficient of thermal expansion of said body of ceramic material to enable said expansion material to expand to a greater extent than said body of ceramic material upon heating of the mold.

23. A mold as set forth in claim 22 wherein said body of ceramic material is an annular plate having a circular outer edge which is disposed outwardly of the lower end portions of said article molds and a circular inner edge which is disposed inwardly of the lower end portions of said article molds, said expansion material including a plurality of strips of material which are disposed in said annular plate at locations spaced from the lower end portions of said article molds.

24. A mold as set forth in claim 23 wherein each of said strips of material extend from the circular inner edge of said annular plate to the circular outer edge of said annular plate.

25. A method of casting a plurality of articles comprising the steps of providing a mold having a ceramic base plate, a plurality of ceramic article molds connected to and extending upwardly from the base plate and a ceramic molten metal distribution system connected to upper end portions of the article molds, said method further including the steps of conducting a flow of molten metal into the distribution system, cracking the base plate at location between the article molds to form a pluraltiy of separate base sections, and moving at least one of the base sections relative to another base section under the influence of forces transmitted from the distribution system to the one base section.

26. A method as set forth in claim 25 wherein the molten metal distribution system includes a primary distribution system separate from the article molds, a secondary distribution system connected to the article molds and a plurality of separable joints interconnecting the primary and secondary distribution systems, said step of conducting a flow of molten metal including conducting said flow from the primary distribution system through the separable joints and secondary distribution system to the article molds, and separating the primary and secondary distribution systems at the separable joints after having performed said step of conducting molten metal from the distribution system to cavities in the article molds.

27. A method as set forth in claim 26 wherein said step of providing a mold includes providing a plurality of bodies of expansion material disposed in the ceramic base plate and having a coefficient of thermal expansion greater than the coefficient of thermal expansion of the ceramic material of the base plate, said step of cracking the base plate including the steps of heating the base plate and bodies of expansion material and thermally expanding the bodies of expansion material to a greater extent than the ceramic material of the base plate.

* * * * *